US008963030B2

(12) United States Patent
Kitahara

(10) Patent No.: US 8,963,030 B2
(45) Date of Patent: Feb. 24, 2015

(54) PUSH SWITCH

(71) Applicant: Tokyo Parts Industrial Co., Ltd., Gunma-ken (JP)

(72) Inventor: Takahisa Kitahara, Isesaki (JP)

(73) Assignee: Tokyo Parts Industrial Co., Ltd., Gunma-ken (JP)

( * ) Notice: Subject to any disclaimer, the term of this patent is extended or adjusted under 35 U.S.C. 154(b) by 112 days.

(21) Appl. No.: 13/772,492

(22) Filed: Feb. 21, 2013

(65) Prior Publication Data

US 2013/0248336 A1 Sep. 26, 2013

(30) Foreign Application Priority Data

Mar. 23, 2012 (JP) ..... 2012-066566

(51) Int. Cl.
*H01H 1/64* (2006.01)
*H01H 13/04* (2006.01)
*H01H 13/52* (2006.01)

(52) U.S. Cl.
CPC ..... *H01H 13/04* (2013.01); *H01H 13/52* (2013.01); *H01H 2221/044* (2013.01); *H01H 2221/05* (2013.01); *H01H 2227/034* (2013.01)
USPC ..... 200/293

(58) Field of Classification Search
USPC ..... 200/293, 341, 302.1–302.2, 296, 345
See application file for complete search history.

(56) References Cited

U.S. PATENT DOCUMENTS

| | | | | |
|---|---|---|---|---|
| 6,768,070 | B2 * | 7/2004 | Lewison et al. | 200/296 |
| 7,230,196 | B2 * | 6/2007 | Toyama | 200/314 |
| 8,044,313 | B2 * | 10/2011 | Yamamoto | 200/314 |
| 2011/0284352 | A1 * | 11/2011 | Kitahara et al. | 200/341 |
| 2012/0006664 | A1 | 1/2012 | Kitahara et al. | |

FOREIGN PATENT DOCUMENTS

| | | |
|---|---|---|
| JP | 2012-018794 | 1/2012 |

* cited by examiner

*Primary Examiner* — Edwin A. Leon
(74) *Attorney, Agent, or Firm* — Jordan and Hamburg LLP

(57) ABSTRACT

A push switch comprising: a switch disposed on a seat; a cylindrical case that accommodates the seat and the switch; and a soft button comprising a side peripheral wall mounted on top of the case, and an upper operating wall, wherein the switch comprises a main portion and an operating portion that projects up from the main portion; the upper operating wall comprises a pressing portion that presses the operating portion; the seat comprises a base on which the switch is placed, a cover that is positioned around the main portion, and an upper wall that is positioned on the upper portion of the cover and covers the switch; the upper wall comprises a through-hole in a position corresponding to the operating portion; and the operating portion and the pressing portion face through the through-hole.

5 Claims, 9 Drawing Sheets

PUSH SWITCH

FIELD OF THE INVENTION

The present invention relates to a push switch using a soft button.

DESCRIPTION OF THE RELATED ART

For example, Patent Document 1 (JP-2012-18794-A) describes a push switch that surrounds a main portion 101 by way of a cover 102 that is higher than the main portion 101 of a switch 100, as shown in FIG. 9. With this push switch, when pressing with an excessive force, the interior of an upper operating wall 103 abuts with the upper face of the cover 102, thus preventing the excessive force from being applied to the switch 100.

However, with the push switch of FIG. 9, because the top of the switch 100 is opened widely, if a button 104 is pressed with an excessive force, not only an operating protrusion 105 but also a wide region that surrounds therearound is easily pressed down excessively. As a result, the operating protrusion 105 has a large elastic deformation, and in particular, if pressed with pointed, hard claws, cracks can easily occur in the upper face of the operating protrusion, and it is feared that durability will decrease.

SUMMARY OF THE INVENTION

The present invention is directed to solving the problems of the conventional technology, such as described above, and an object thereof is to provide a highly durable push switch.

A push switch of the present invention comprising: a switch disposed on a seat; a cylindrical case that accommodates the seat and the switch; and a soft button comprising a side peripheral wall mounted on top of the case, and an upper operating wall, is a push switch characterized in that:

- the switch comprises a main portion, and an operating portion that projects up from the main portion;
- the upper operating wall comprises a pressing portion that presses the operating portion;
- the seat comprises a base on which the switch is placed, a cover that is positioned around the main portion, and an upper wall that is positioned on the upper portion of the cover and covers the switch;
- the upper wall comprises a through-hole in a position corresponding to the operating portion, and a gap is disposed and provided in the interior of the upper operating wall; and
- the operating portion and the pressing portion are opposed through the through-hole.

With the push switch of the present invention, it is preferable that the cover and the main portion are in contact.

With the push switch of the present invention, it is preferable that an outwardly convex curved face is provided on the upper corner of the through-hole.

By virtue of the push switch of the present invention, by way of providing an upper wall, which covers the switch, and which is positioned on top of the cover, if the upper face of the pressing portion is pressed with an excessive force, the pressing portion is not readily pressed down further than a prescribed position. Thus, the durability of the pressing portion can be improved in that this is not readily elastically deformed beyond a prescribed shape, and cracks do not readily occur in the upper face of the pressing portion that is pressed.

DESCRIPTION OF THE PREFERRED EMBODIMENTS

Hereinafter modes of embodiment of the present invention are described based on the drawings.

Figure 1:
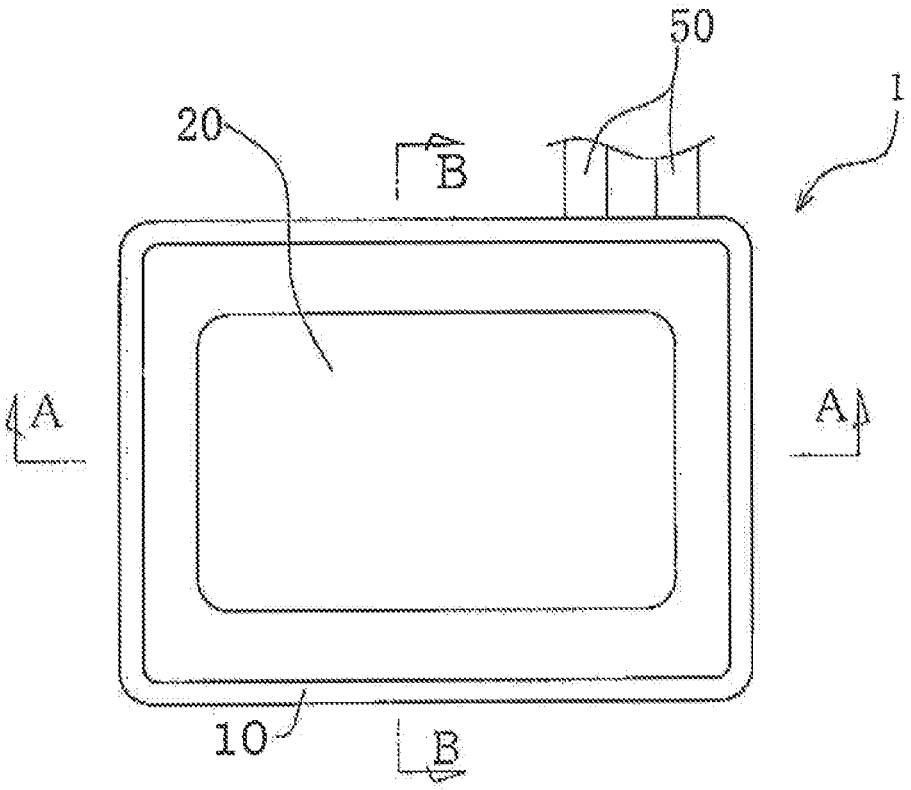
FIG. 1 is a top view of a push switch according to an embodiment of the present invention.
Figure 2:
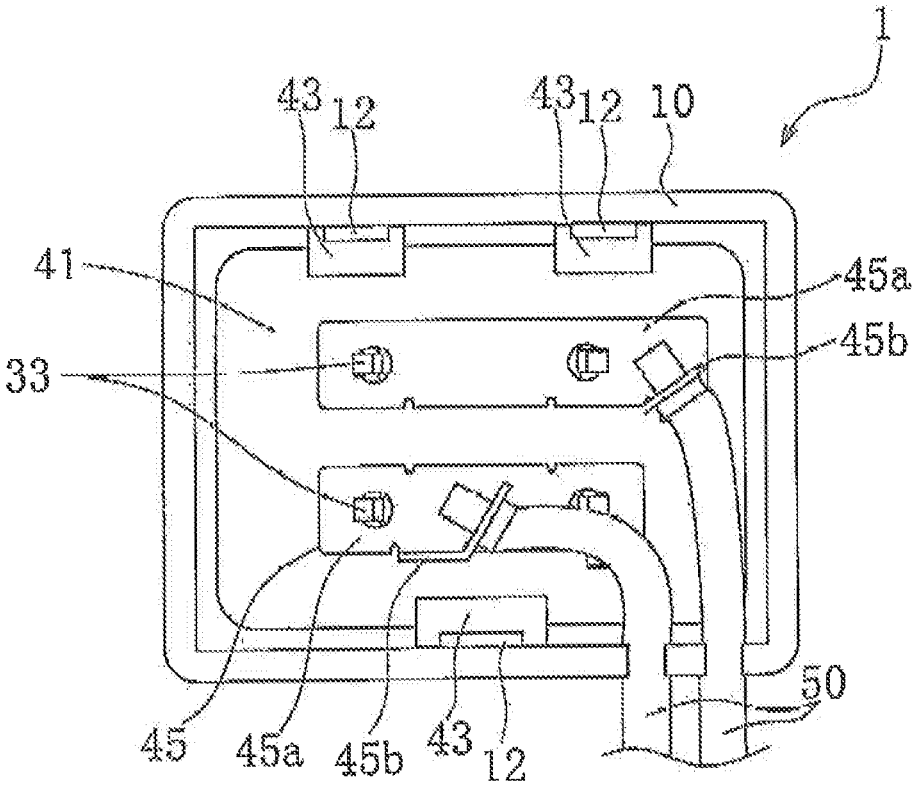
FIG. 2 is a bottom view of a push switch according to an embodiment of the present invention.
Figure 3:
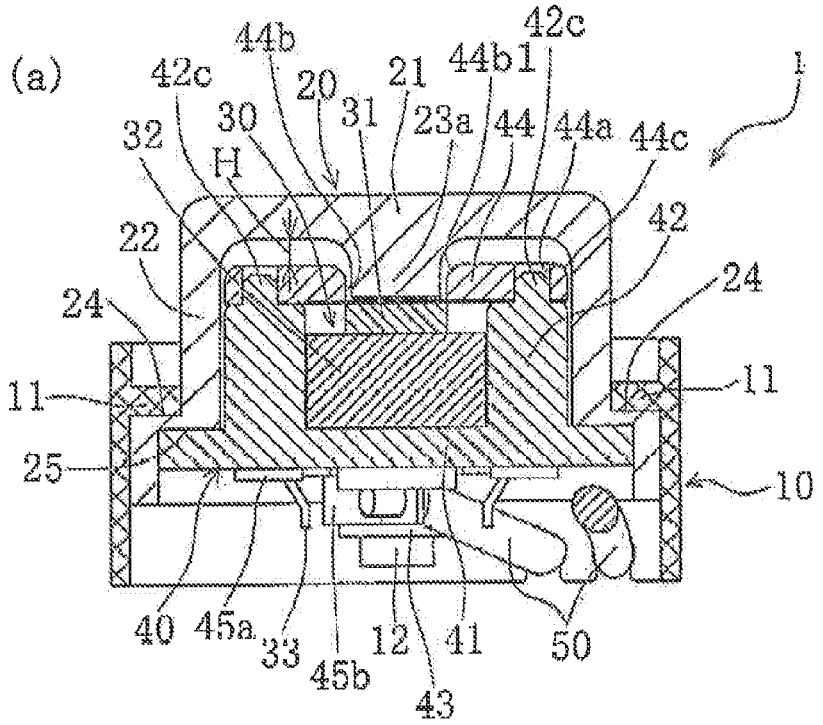
FIG. 3 is a sectional view of a push switch according to an embodiment of the present invention; (a) is a sectional view at the line A-A in FIG. 1, and (b) is a sectional view at the line B-B in FIG. 1.
Figure 3:
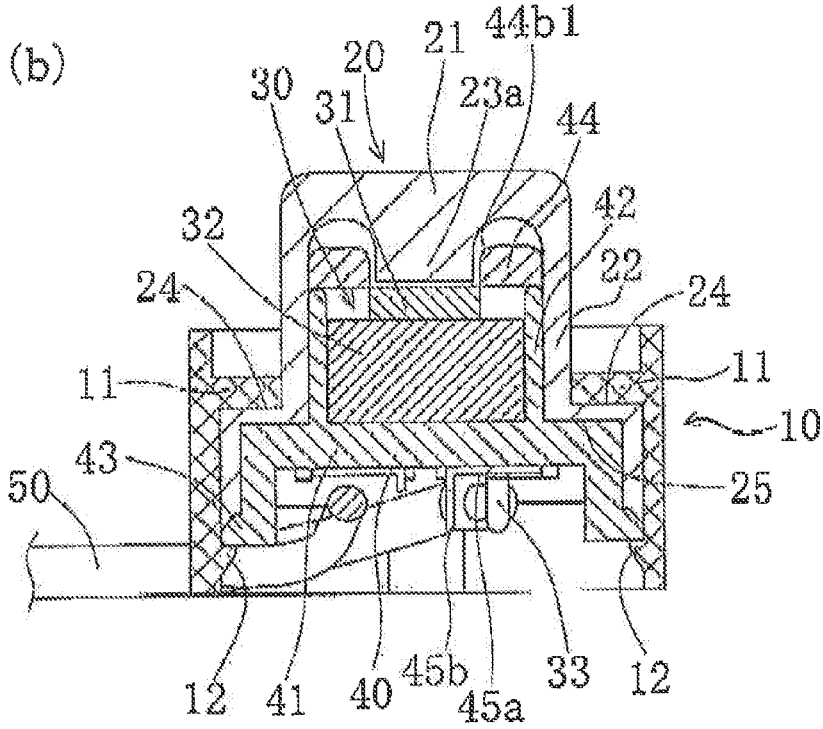
Figure 4:
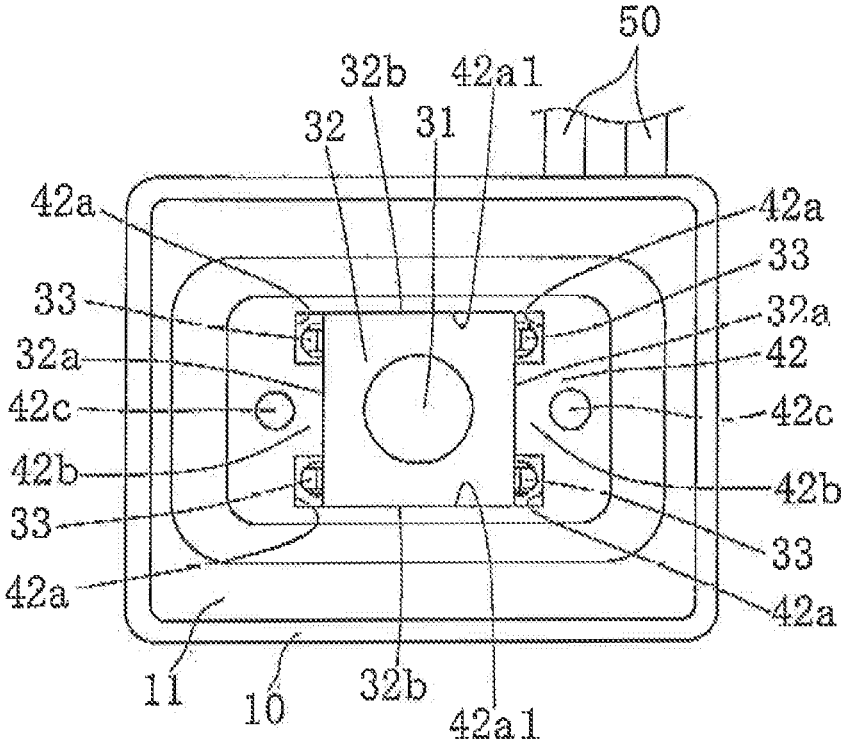
FIG. 4 is a top face section with a button 20 and upper wall 44 removed from a push switch according to an embodiment of the present invention.

FIGS. 1 to 4 show a push switch 1 according to an embodiment of the present invention; FIG. 1 is a top view, FIG. 2 is a bottom view, FIG. 3(*a*) is a sectional view at the line A-A in FIG. 1, FIG. 3(*b*) is a sectional view at the line B-B in FIG. 1, and FIG. 4 is a top face section with the button and upper wall removed.

The push switch 1 of this example is intended to be mounted on door handle device for a vehicle, which is not shown. When a user operates a door lock device, unlocking or locking of the door can be performed by pressing a button 20 of the push switch 1 that is exposed from the door handle device for a vehicle.

The push switch 1 comprises a case 10, a button 20, a switch 30, a seat 40, and a lead 50.

The case 10 is integrally formed into a cylinder from a hard resin, and provides a protrusion 11 in the upper interior and a locking claw 12 on the lower interior.

Note that the protrusion 11 is formed along the entire interior circumference, and locking claws 12 are formed in three locations.

The button 20 is formed from a soft resin having elasticity such as rubber, comprises an upper operating wall 21 and a side peripheral wall 22 that drops from the peripheral edge thereof, and is provided with an opening on the bottom face.

A pressing portion 23*a* is provided in the center of the lower face of the upper operating wall 21. Furthermore, an upper step 24 and a lower step 25 are provided in the side peripheral wall 22.

The button 20 is mounted in the case 10 in a situation wherein the protrusion 11 of the case 10 abuts the upper step 24.

Note that if the push switch 1 is installed on a door handle, which is not shown, this is mounted on the interior of the door handle so that the upper operating wall 21 of the button 20 is exposed to the exterior.

The switch 30 has a cylindrical operating portion 31, a cuboid main portion 32, and a terminal 33.

The operating portion 31 projects up from inside the main portion 32, is configured to be moveable in the vertical direction in the drawing, and is biased toward the top of the drawing by way of an elastic member, which is not shown, in the main portion 32.

As shown in FIG. 4, two terminals 33 are drawn from each of side faces 32*a*, 32*a* from among the mutually opposing side faces 32*a*, 32*a* and side faces 32*b*, 32*b* of the main portion 32.

The switch 30 is placed on the seat 40, and the switch 30 and the seat 40 are accommodated in the case 10.

The seat 40 is formed from a hard resin, and comprises: a planar base 41, on which the switch 30 is placed; a cover 42, which is positioned around the main portion 32; a stopper 43 that is formed on the bottom face of the base 41; and an upper wall 44, which is positioned in the upper portion of the cover 42.

With the seat 40 of this example, the base 41, the cover 42, and the stopper 43 are integrally formed, and the upper wall 44 is fixed to the top of the cover 42.

The cover 42 of this example is provided upright from the base 41 so as to surround the entire circumference of the side face of the main portion 32 of the switch 30, and is in contact with the four side faces 32*a*, 32*b* of the main portion 32.

Specifically, as shown in FIG. 4, a recess 42*a* is provided in the cover 42 in a position corresponding to the terminals 33 of the main portion 32, following the embedding direction of the switch 30, and a projection 42*b* is provided between the recesses 42*a*. Furthermore, the projection 42*b* is in contact with the side face 32*a* of the main portion 32 between two terminals 33, and a side face 42*a*1 of the cover is in contact with the entire side face 32*b* of the main portion 32 that does not have terminals 33.

Moreover, the top face of the cover 42 is provided with a fitting protrusion 42*c*.

The upper wall 44 is formed in a plane, and is fixed to the upper portion of the cover 42 in a situation wherein a fitting projection 42*c* of the cover 42 is fit with a fitting hole 44*a* that is provided in the upper wall 44. The upper wall 44 covers the top face of the switch 30 that is disposed in the cover 42, and has a through-hole 44*b* in the position corresponding to the operating portion 31.

Furthermore, the operating portion 31 and pressing portion 23*a* are facing through the through-hole 44*b*. In other words, the pressing portion 23*a*, which projects further into the interior than the upper operating wall 21, in a situation where this is inserted in the through-hole 44*b* of the upper wall 44, faces and is adjacent to or abuts the operating portion 31 of the switch 30.

An upper corner 44*b*1 of the through-hole 44*b* is provided with an outwardly convex, gradually curved face. The cross-sectional form of the curved face is not necessarily an arch-shaped circular form, but includes any elliptical arch-shape and chamfered corners. Furthermore, an upper face corner 44*c* of the outer circumference of the upper wall 44 is formed to be an outwardly convex, gradually curved face.

Furthermore, the upper wall 44 is disposed to have a gap in the interior of the button 20. In the present example, the distance H between the upper operating wall 21 of the button 20 and the upper wall 44 is set to be approximately the same as the stroke length of pressing the button 20 until the switch 30 is ON.

A conductive terminal member 45 is mounted on the bottom face of the base 41.

The terminal member 45 comprises a planar portion 45*a* and a connection area 45*b* that is provided upright from a fixed position of the planar portion 45*a*.

The terminal 33 of the switch 30 is drawn downward through the through-holes, which are provided in the planar portion 45*a* of the base 41, and is electrically connected to the planar portion 45*a* by way of solder or the like.

Furthermore, a lead 50 is electrically connected to the connection area 45*b* of the terminal member 45, and the lead 50 is drawn to the exterior of the case 10.

Stoppers 43 are disposed in three positions corresponding to the locking claws 12 of the case 10, and are each locked in a locking claw 12. Thus, a seat 40 is fixed to the interior of the case 10 in the situation where the peripheral edge of the base 41 abuts the lower step 25 of the button 20.

Figure 5:
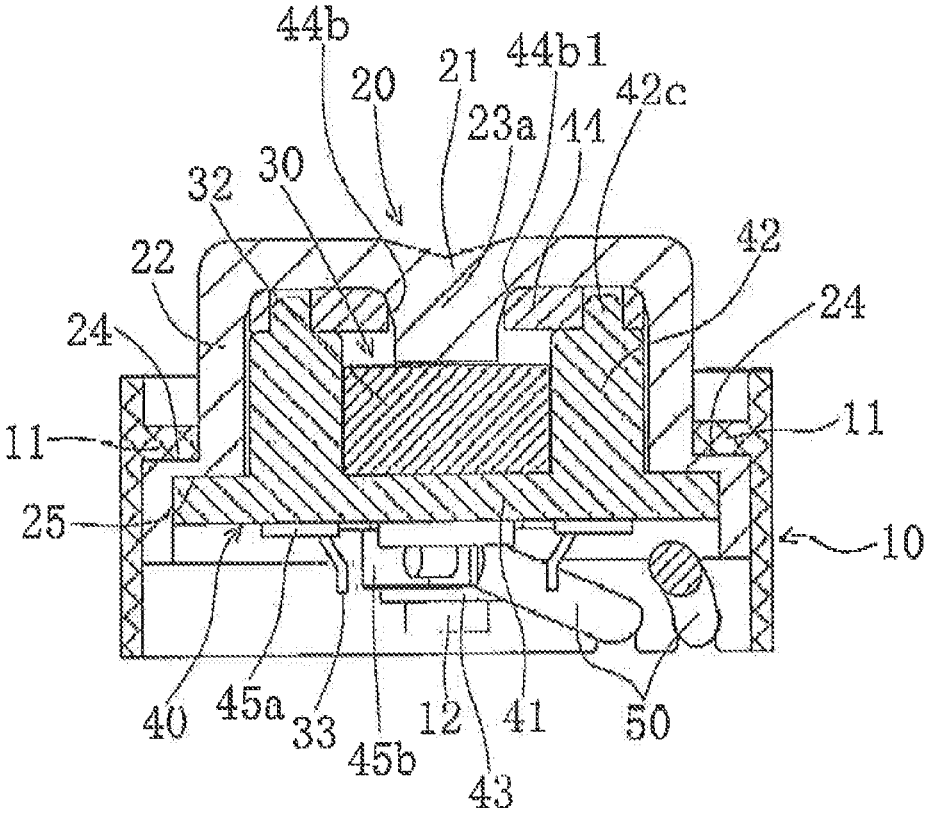
FIG. 5 is a sectional view for describing the operation of a push switch according to an embodiment of the present invention.

The push switch 1 of the present example, which is configured as described above, transmits a signal to the exterior by way of the lead 50 by the elastic deformation of the pressing portion 23*a*, as shown in FIG. 5, and the switch 30 being turned ON by the pressing down of the operating portion 31, when the upper operating wall 21 of the button 20 is pressed from the top to the bottom in the drawing shown in FIG. 3(*a*).

At this time, when the soft upper face of the pressing portion 23*a* is pressed with excessive force, because the stroke length for the button 20 is limited by the upper wall 44, application of an excessive load on the switch can be prevented. In other words, when the upper face of the soft pressing portion 23*a* is pressed with excessive force, because the inner face of the button 20 abuts the upper wall 44 and the pressing load is communicated to the case 10 through the base 41, which is integrally formed with the cover 42, and stopper 43, the excessive load does not directly act on the switch 30.

Furthermore, according to the push switch of the present example, by way of providing the upper wall 44, which covers the switch 30, and which is positioned on top of the cover 42, if the upper face of the pressing portion 23*a* is pressed with an excessive force, the pressing portion is not readily pressed down further than a prescribed position. Thus, the durability of the pressing portion can be improved in that this is not readily elastically deformed beyond a prescribed shape, and cracks do not readily occur in the upper face of the pressing portion that is pressed.

Furthermore, with the push switch of the present example, because the cover 42 of the seat 40 is in contact with the main portion 32 of the switch 30, if the upper wall is pressed with excessive force, the cover 42 does not easily slant toward the inside of the switch with the bottom edge of the cover as a fulcrum, and because the stroke length for the button is reliably limited by the upper wall, the pressing portion does not easily elastically deform beyond what is prescribed, thus the durability can be further improved. In particular, with the present example, because the configuration is such that the cover is in contact with the four side faces 32*a*, 32*b* of the main portion 32 of the switch 30 so as to surround the entire circumference, if the upper wall is pressed with excessive force, the cover 42 does not easily slant toward the inside of the switch with the bottom edge of the cover as a fulcrum, and in particular, the stroke length for the button can be effectively limited by the upper wall.

Note that the contact structure of the cover and main portion in the present invention is not limited to the example described above, and may be a structure wherein the projection 42*b* is in contact with both side faces 32*a* of the main portion 32 between the two terminals 33 or may be a structure wherein the cover is in contact with both side faces 32*b* of the main portion 32 without terminals 33, for example, if the deformation of the cover is controlled when the upper wall is pressed with an excessive force.

Furthermore, with the push switch of the present example, the cover 42 is provided with a recess 42*a*, which is provided in a position corresponding to the terminals 33 of the main portion 32, following the embedding direction of the switch 30, whereby the terminals 33 do not directly come into contact with the inner side face of the cover 42 and the terminals are not deformed when the switch 30 is embedded into the cover 42.

Furthermore, with the push switch of the present example, the pressing portion 23*a*, which projects further into the interior than the upper operating wall 21 of the button 20, in a situation where this is inserted in the through-hole 44*b* that is provided in the hard upper wall 44, faces the operating portion 31 of the switch 30. Thus, if the button is pressed, the button inner face on the outer circumference of the pressing portion abuts the upper corner of the through-hole. Supposing that an upper corner of a through-hole had a cross-sectional right angle shape that had no modification, then a soft button interior can be damaged during the pressing operation.

Meanwhile, with the push switch of the present example, because an outwardly convex, curved face is provided on the upper corner 44*b*1 of the through-hole 44*b*, the button interior is not readily damaged during the button pressing and durability can be improved.

Furthermore, with the push switch of the present example, because a gradually convex, curved face is formed on the exterior of the upper face corner 44*c* of the outer circumference of the upper wall 44, if the button 20 is pressed from an inclined horizontal direction, the interior of button 20 is not damaged, and breaking the soft button 20 can be effectively prevented.

An embodiment of the present invention was described above, but the present invention is not limited to such an embodiment, and needless to say, suitable changes are possible within a scope that does not depart from the gist of the present invention.

Figure 6:
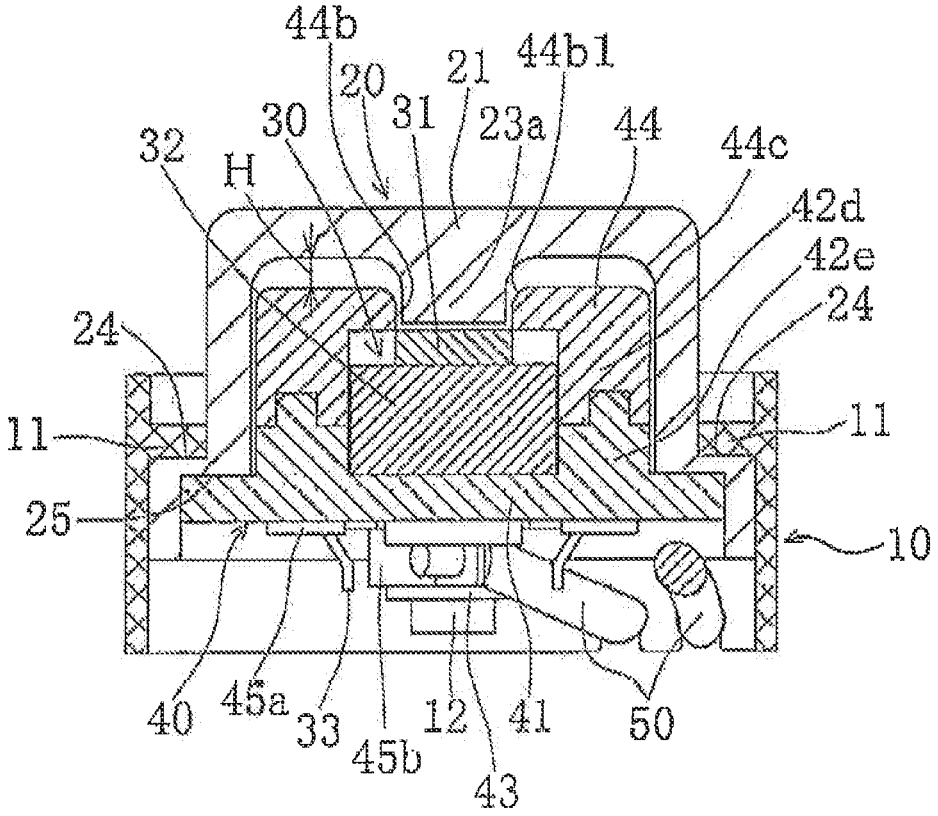
FIG. 6 is a sectional view showing a first variant of a push switch according to an embodiment of the present invention.
Figure 7:
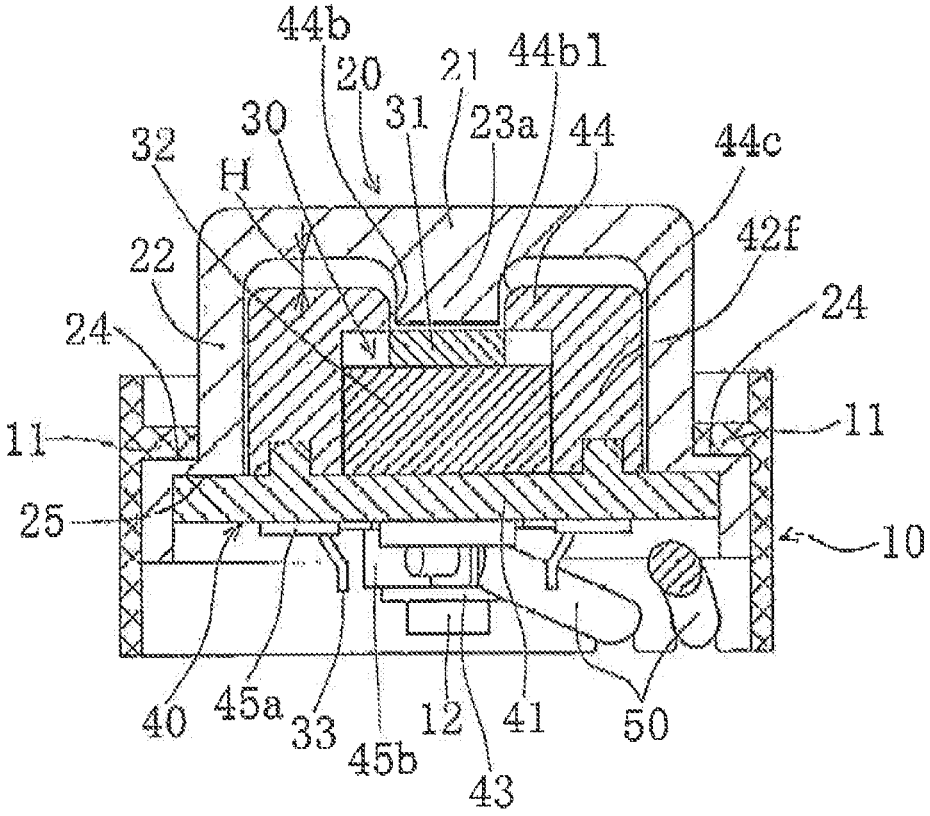
FIG. 7 is a sectional view showing a second variant of a push switch according to an embodiment of the present invention.

Specifically, for example, with the aforementioned embodiment, the upper wall 44, which covers the switch 30, is recess-protrusion fit in the upper portion of the cover 42, but if the elastic deformation of a pressing portion beyond what is prescribed can be prevented, then an upper wall 44, which is integrally formed with the upper portion 42*d* of a cover that is divided vertically, may be recess-protrusion fit with a lower portion 42*e* of the cover, as shown in FIG. 6 (variant 1), or a cover 42 and a base 41 may be divided, and an upper wall 44, which is integrally formed with the divided cover 42*f*, may be recess-protrusion fit with the base 41, as shown in FIG. 7 (variant 2).

Figure 8:
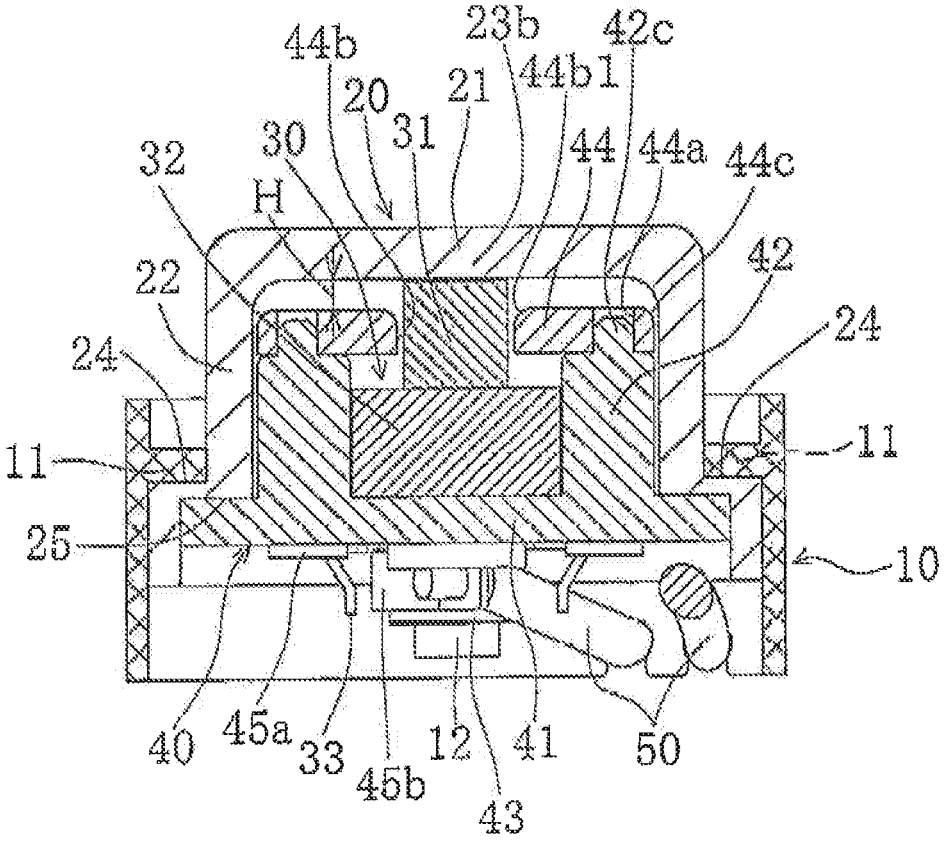
FIG. 8 is a sectional view showing a third variant of a push switch according to an embodiment of the present invention.
Figure 9:
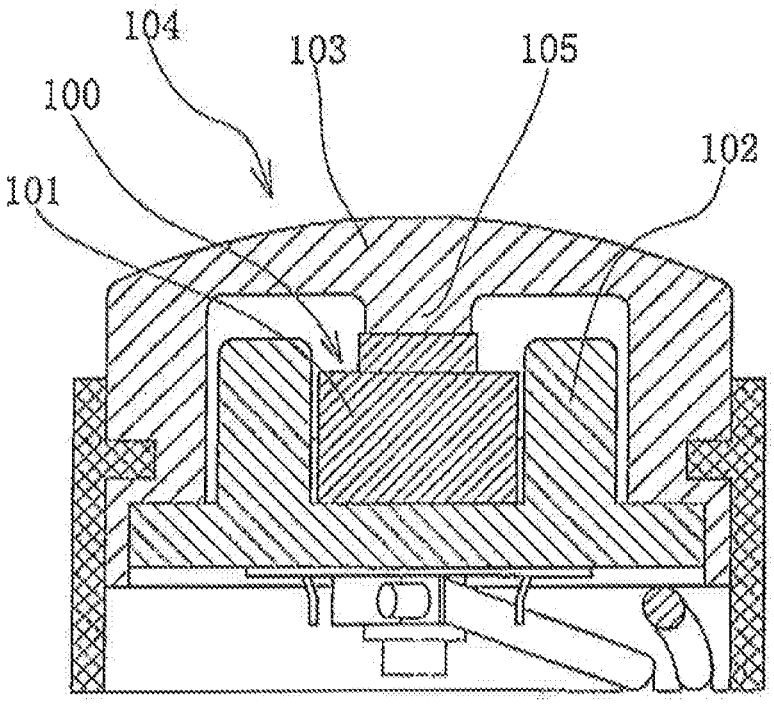
FIG. 9 Prior Art
FIG. 9 is a sectional view of a conventional push switch.

Furthermore, with the aforementioned embodiment, the pressing portion 23*a*, which projects further into the interior than the upper operating wall 21 of the button 20, in a situation where this is inserted in the through-hole 44*b* of the upper wall 44, faces the operating portion 31 of the switch 30, but the operating portion 31 of the switch 30 may project upward from the through-hole 44*b* of the upper wall 44, and an inner bottom face (pressing portion 23*b*) of the upper operating wall 21 may face and be adjacent to or abut the operating portion 31, as shown in FIG. 8 (variant 3).

Furthermore, with the seat 40 of the aforementioned embodiment, the base 41, the cover 42, and the stopper 43 are integrally formed with a hard resin, and the hard resin upper wall 44 is positioned on the cover 42, but the base 41, the cover 42, the stopper 43, and the upper wall 44 may be integrally formed with a hard resin. With the seat of this case, the switch 30 is inserted from the bottom of a through-hole provided in the approximate center of the base 41 and fixed by snap-fitting in the cover 42, so that when the switch 30 is pressed, the switch 30 does not fail out in the downward direction. Even supposing that a button is pressed with excessive force, the pressing load applied to a switch need not be large because an upper wall that is positioned on the upper portion of the cover and covers the switch is provided. Furthermore, with this seat, in addition to having an effect in the same manner as the aforementioned embodiment, the number of parts is fewer compared to the aforementioned embodiment because the base 41, the cover 42, the stopper 43, and the upper wall 44 are integrally formed with a hard resin.

DESCRIPTION OF REFERENCE NUMERALS AND SIGNS

1 push switch
10 case
11 protrusion
12 locking claw
20 button
21 upper operating wall
22 side peripheral wall
23*a* pressing portion
23*b* pressing portion
24 upper step
25 lower step
30 switch
31 operating portion
32 main portion
32*a* main portion side face
32*b* main portion side face
33 terminal
40 seat
41 base
42 cover
42*a* recess
42*a*1 cover side face
42*b* projection
42*c* fitting protrusion
42*d* cover upper portion
42*e* cover lower portion
42*f* cover
43 stopper
44 upper wall
44*a* fitting hole
44*b* through-hole
44*b*1 upper face corner
44*c* upper face corner
45 terminal member
45*a* planar portion
45*b* connection area
50 lead

What is claimed is:

1. A push switch comprising:

a switch disposed on a seat;

a cylindrical case that accommodates the seat and the switch; and a soft button comprising a side peripheral wall mounted on top of the case, and an upper operating wall; and wherein the switch comprises a main portion, and an operating portion that projects up from the main portion;

wherein the upper operating wall comprises a pressing portion that presses the operating portion;

wherein the seat comprises a base formed from a hard resin, on which the switch is placed, a cover that is positioned around the main portion, and an upper wall that is positioned on the upper portion of the cover and covers the switch;

wherein the upper wall comprises a through-hole in a position corresponding to the operating portion, and a gap is disposed and provided in the interior of the upper operating wall;

wherein the operating portion and the pressing portion face through the through-hole; and wherein the cover is in contact with the main portion of the switch.

2. The push switch recited in claim 1, wherein the main portion is cuboid having two first-side faces that face each other and two second-side faces that face each other; and wherein the switch has two first-terminals drawn from one of the two first-side faces and two second-terminals drawn from another one of the two first-side faces;

wherein for each one terminal among said two first-terminals and said two second-terminals the cover is provided with a recess in a position corresponding to said one terminal, said recess following an embedding direction of the switch, wherein a first-projection portion of the cover occurs between said two first-terminals and a second-projection portion of the cover occurs between said two second-terminals.

3. The push switch recited in claim 2, wherein said cover is on contact with said two second-side faces.

4. The push switch recited in claim 1, wherein an outwardly convex curved face is provided on the upper corner of the through-hole.

5. The push switch recited in claim 3, wherein an outwardly convex curved face is provided on the upper corner of the through-hole.

* * * * *